United States Patent [19]

McCluskey

[11] 4,271,893

[45] Jun. 9, 1981

[54] WINDOW BLIND CORD CONTROL APPARATUS

[76] Inventor: William A. McCluskey, 1199 E. Madison Ave., El Cajon, Calif. 92021

[21] Appl. No.: 23,539

[22] Filed: Mar. 26, 1979

[51] Int. Cl.[3] ..... E06B 9/38

[52] U.S. Cl. ..... 160/178 R; 242/107.13

[58] Field of Search ..... 160/168, 173, 178 R, 160/178 C, 84 R; 185/37, 39; 242/107, 107.11, 107.12, 107.13, 107.3

[56] References Cited

U.S. PATENT DOCUMENTS

| | | | |
|---|---|---|---|
| 906,045 | 12/1908 | Martin | 242/107.13 |
| 2,989,267 | 6/1961 | Mehl | 242/107.13 |
| 3,605,852 | 9/1971 | Vecchiarelli | 160/168 |
| 3,795,266 | 3/1974 | Debs | 160/168 |

*Primary Examiner*—Peter M. Caun
*Attorney, Agent, or Firm*—Brown & Martin

[57] ABSTRACT

A window blind cord control apparatus for controlling the disposition of a set of two or more closely gathered cords extending out from an opening in a headrail and extending longitudinally through the headrail to separate positions where they are respectively attached to a window blind for raising and lowering the blind, including a headrail comb defining an array of parallel slots for receiving and guiding the gathered cords, for placement within the headrail near the opening from which the cords extend for preventing the gathered cords from becoming raveled within the headrail; and a cord collector for collecting the cords extending out from the opening in said headrail. The cord collector includes a multiple spool reel for respectively winding the cords on separate spools; a spring for biasing the reel for winding the cords onto the spools; a sleeve for gathering the cords; and a cord collector comb defining an array of parallel closed-end slots for receiving and guiding each of the gathered cords. The cord collector comb is placed between the sleeve and the reels for preventing the gathered cords from becoming raveled outside of the headrail.

6 Claims, 7 Drawing Figures

WINDOW BLIND CORD CONTROL APPARATUS

BACKGROUND OF THE INVENTION

The present invention generally pertains to cord-controlled apparatus for varying the disposition of a window blind, and is particularly directed to an improvement in such apparatus for controlling the disposition of the cords themselves to prevent closely gathered cords from becoming raveled.

A cord-controlled window blind apparatus, essentially includes a window blind; a set of cords coupled to the blind for raising and lowering the blind by operating the cords; a headrail from which the blind may be suspended and through which the cords extend longitudinally to separate positions where they are respectively attached to the blind. The headrail also contains an opening at which the cords are closely gathered out from which the cords extend.

A locking device is disposed in the headrail adjacent the opening for clamping the cords to hold the blind at whatever height it has been moved to by operation of the cords.

The types of window blinds that typically are controlled by such an apparatus include venetian blinds and woven wood blinds. A particularly popular type of venetian blind controlled by this type of apparatus is commonly known as "Levalors". In the cord control apparatus, two or four separate cords are used to control the raising and the lowering of the blind. These cords are gathered and extend from the opening in the headrail that is adjacent the locking device and have a tendency to become raveled.

Raveling of the cords has not been a significant problem in cord-controlled window blind apparatus having only two cords. It is when there are more than two cords that the cords become so raveled as to impair smooth operation of the apparatus.

SUMMARY OF THE INVENTION

The present invention is a window blind cord control apparatus for controlling the disposition of a set of two or more closely gathered cords extending out from an opening in a headrail and extending longitudinally through the headrail to separate positions where they are respectively attached to a window blind for raising and lowering the blind by operating the cords. In one aspect of the present invention the apparatus is characterized by a headrail comb defining an array of parallel slots for receiving and guiding each of the gathered cords, for placement within the headrail near the opening from which the cords extend for preventing the gathered cords fom becoming raveled within said headrail.

The apparatus of the present invention is further characterized by a cord collector for collectfing the cords extending out from the opening in the headrail. The cord collector includes a multiple spool reel for respectively winding the cords on separate spools; a spring for biasing the reel for winding the cords onto the spools; a sleeve for gathering the cords; and a cord collector comb defining an array of parallel slots for receiving and guiding each of the gathered cords. The cord collector comb is placed between the sleeve and the reel for preventing the gathered cords from becoming raveled outside of the headrail.

Additional features of the present invention and various advantages thereof are discussed in relation to the description of the preferred embodiment.

DESCRIPTION OF THE PREFERRED EMBODIMENT

Figure 1:
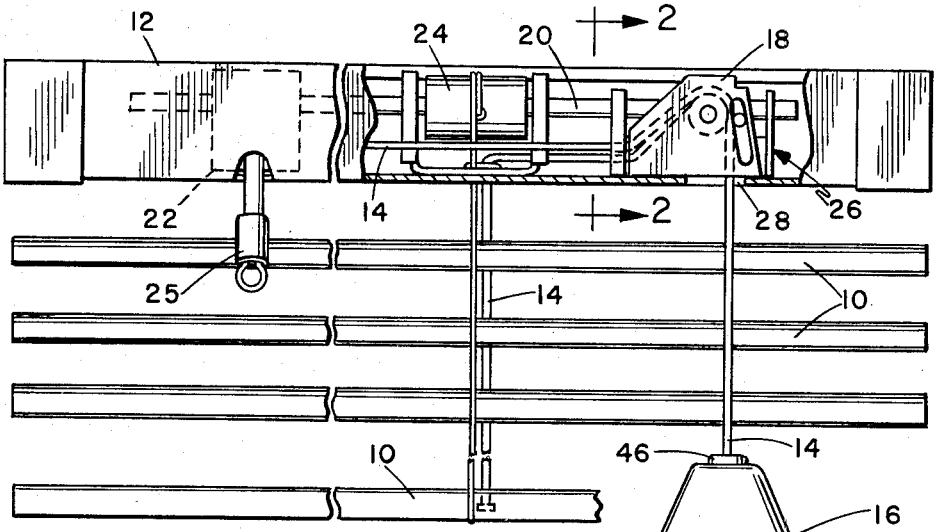
FIG. 1 is a side elevation view, partially cut away, of a window blind apparatus invorporating the cord control apparatus of the present invention.
Figure 2:
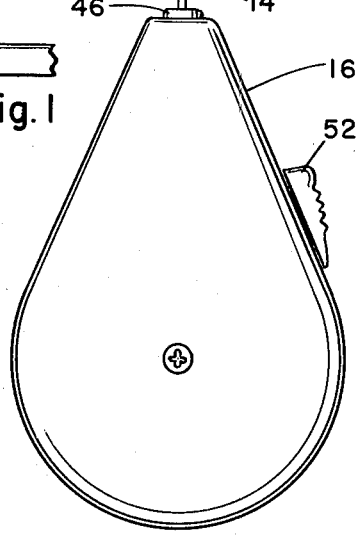
FIG. 2 is an enlarged sectional view taken on line 2—2 of FIG. 1.
Figure 2:
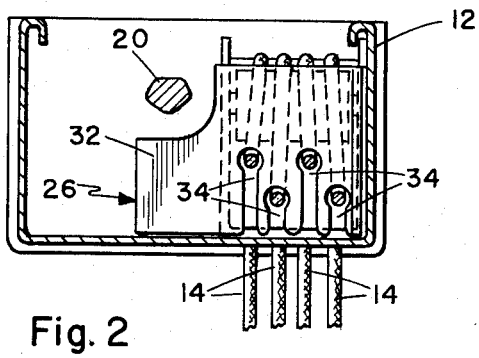
Figure 3:
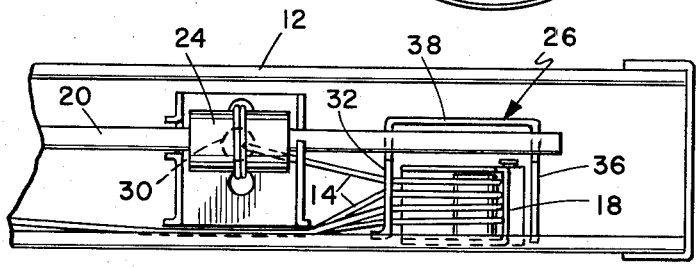
FIG. 3 is a top plan view of a portion of the structure of FIG. 1.
Figure 4:
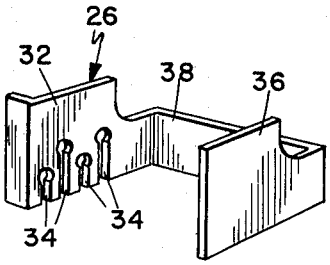
FIG. 4 is a perspective view of the comb.
Figure 5:
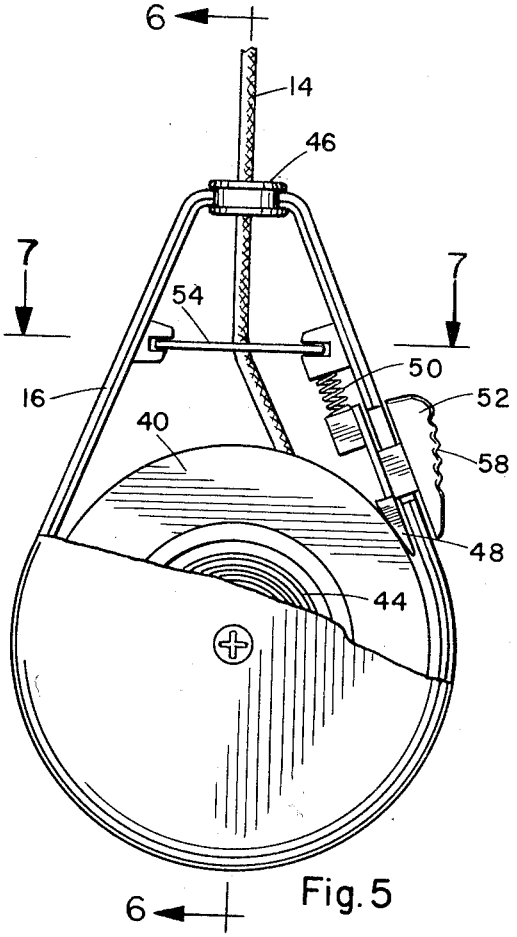
FIG. 5 is an enlarged side elevation view of the cord collector, with a portion cut away.
Figure 6:
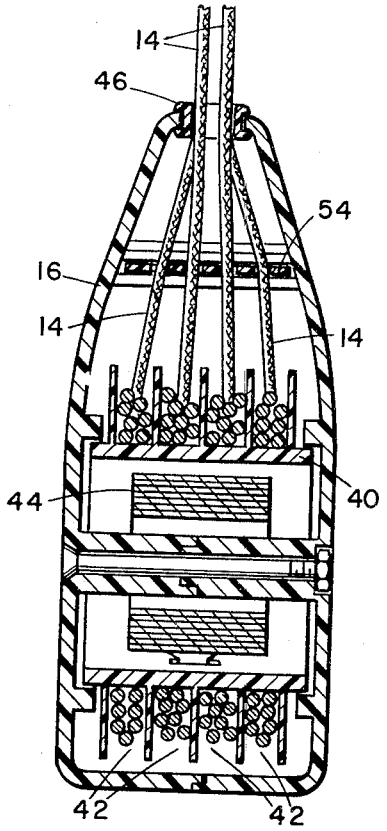
FIG. 6 is a sectional view taken on line 6—6 of FIG. 5.
Figure 7:
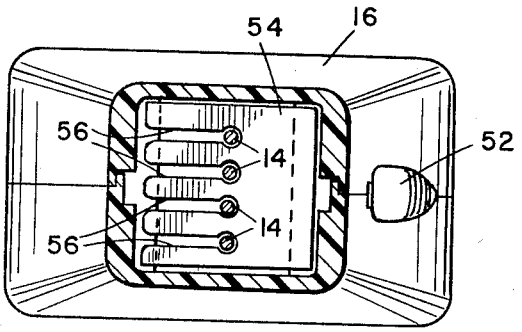
FIG. 7 is a sectional view taken on line 7—7 of FIG. 5, illustrating the cord collector comb.

The preferred embodiment of the present invention is an improved window blind control apparatus of the multiple slat type. Referring to FIG. 1, the apparatus includes a window blind consisting of a plurality of slats 10, a headrail 12, a set of cords 14, a cord collector 16, a locking device 18, a tilt control rod 20, a tilt mechanism 22, a set of slat control cords in the form of cord ladders 23 which are attached to tumblers 24 (only one of which is shown), a wand coupler 25, and a headrail comb 26.

The cords 14 are attached to the lowermost slat 10, so that the slats 10 are brought together and the blind is raised by pulling on the cords 14. The cords 14 are held in place by the locking device 18 so as to hold the blind in the position to which it is raised. The locking device 18 releases its hold on the cords 14 so as to enable the blind to be lowered when the cords 14 are pulled at an angle, as is well known to most persons who have used venetian blinds.

The headrail 12 contains an opening 28 through which the set of gathered cords 14 extend to the cord collector 16. The locking device 18 is disposed in the headrail 12 adjacent the opening 28. The headrail 12 further contains four openings 30 through which the four cords 14 respectively extend for individual attachment to the lowermost slat 10 of the blind at four separate positions. The cords 14 extend longitudinally within the headrail 12 to the separate positions of the openings 30 where they are respectively attached to the blind.

The headrail 12 also contains the tilt control rod 20, the tilt mechanism 22 and the tumblers 24. The cord ladders 23 support the slats 10 in spaced relation and their upper ends are wrapped around the tumblers 24, which are keyed to the tilt control rod 20. The tilt control rod 20 is rotated by operation of the tilt mechanism 22 in response to operation of a wand (not shown) which is attached to the tilt mechanism by the wand coupler 25. When the wand is rotated, the tilt mechanism 22 rotates the tilt rod 20 to vary the tilt of the slats 10, to thereby open and close the blind.

Referring to FIGS. 1, 2, 3 and 4, the headrail comb 26 includes a first end wall 32 having an array of parallel slots 34 for receiving and guiding each of the gathered cords 14, for preventing the gathered cords 14 from becoming raveled within the headrail 12. The headrail comb 26 also includes a second end wall 36 and a rear wall 38. The headrail comb 26 is positioned in the headrail 12 near the opening 28 so that the first wall 32 is closely disposed on the side of the locking device 18 and the opening 28 from which the cords 14 extend longitudinally within the headrail 12. The first wall 32 generally faces the direction to which the cords 14 extend within the headrail 12. The wall 36 is generally parallel to the first wall 32, and is closely disposed on the opposite side of the locking device 18 and the opening 28 within the headrail 12. The wall 38 rigidly connects the first and second walls 32, 36 in a U-shaped configuration which straddles the locking device 18 to prevent longitudinal movement of the headrail comb 26 within the headrail 12.

Note that the tilt rod 20 extends longitudinally through the headrail 12 past the opening 28. The first and second walls 32, 36 of the headrail comb 26 are cut out to fit under the tilt rod to prevent headrail comb 26 from moving vertically. The closed ends of the slots 34 are wider than the remaining portions of the slots 34 for retaining the cords 14 in the closed ends. Adjacent slots 34 are of different depths so that the cords are staggered and the slots 34 may be moe closely disposed in relation to each other.

Referring to FIGS. 1, 5, 6 and 7, the cord collector 16 is used for collecting the cords 14 extending out from the opening 28 in the headrail 12. The cord collector 16 includes a multiple spool reel 40 for respectively winding the cords 14 on separate spools 42; a coiled spring 44 for biasing the reel 40 for winding the cords 14 onto the spools 42; a sleeve 46 for gathering the cords 14, a brake 48, a brake spring 50, a brake release button 52 and a cord collector comb 54.

The cord collector comb 54 has an array of parallel slots 56 for receiving and guiding the gathered cords 14. The cord collector comb 54 is placed between the sleeve 46 and the reel 40 for preventing the gathered cords 14 from becoming raveled within the cord collector.

The closed ends of the slots 56 in the cord collector comb 54 are wider than the remaining portions of the slots 56 for retaining the cords 14 in the closed ends of the slots.

The brake 48 is biased by the brake spring 50 to bind against the reel 40 and lock the cord collector at any required position on the cords. To release the brake 48, the brake release button 52 is pushed upward. The brake release button 52 has a corrugated surface 58 to enhance the gripping thereof.

The cord collector 16 is particularly useful for collecting the gathered cords 14 that extend from the opening 28 in the headrail 12 when the blind has been raised, to thereby get the cords "out of the way" and/or out of sight. The cord collector 16 is raised and the cords 14 are wound upon the spools 42 by the force of the coiled spring 44. The cord collector 16 can be retained on a hook or some other retainer (not shown) positioned behind drapes, a cornice or a valance so as to be kept out of sight.

The window blind control apparatus of the present invention also is applicable to other types of window blinds that are controlled by the operation of two or more cords.

What is claimed is:

1. Cord control apparatus for a window blind having an elongated headrail, a plurality of spaced slats suspended below the headrail, tilt control means coupled to the slats for controlling the tilt thereof, with a tilt control rod extending longitudinally in the headrail, a plurality of cords secured to the lowermost slat and passing through the slats into the headrail at a longitudinally spaced position, the headrail having an exit opening adjacent one end, said cords extending along the headrail and collectively through said opening, locking means adjacent said opening through which the cords pass for selective frictional locking, the cord control apparatus comprising:

a headrail comb mounted adjacent the locking means with a plurality of spaced slots for receiving and guiding the cords separately into the locking means, said headrail comb being a substantially U-shaped element having a pair of end walls and a connecting wall, the end wall being spaced to straddle said locking means and retain the comb against longitudinal displacement in the headrail, said slots being in one of said end walls.

2. Cord control apparatus according to claim 1, wherein portions of said end walls and the connecting wall extend under the tilt control rod and retain the comb against vertical displacement.

3. Cord control apparatus according to claim 1, wherein said slots have enlarged closed end portions through which the cords freely pass.

4. Cord control apparatus according to claim 3, wherein said enlarged closed end portions are vertically staggered.

5. Cord control apparatus for a window blind having an elongated headrail, a plurality of spaced slats suspending below the headrail, tilt control means coupled to the slats for controlling the tilt thereof, with a tilt control rod extending longitudinally in the headrail, a plurality of cords secured to the lowermost slat and passing through the slats into the headrail at longitudinally spaced positions, the headrail having an exit opening adjacent one end, said cords extending along the headrail and collectively through said opening, locking means adjacent said opening through which the cords pass for selective frictional locking, the cord control apparatus comprising:

a headrail comb mounted adjacent the locking means with a plurality of spaced slots for receiving and guiding the cords separately into the locking means, a cord collector for holding the cords extending from the exit opening, the cord collector having a multiple spool reel on which the cords are individually wound, the reel being biased to wind up the cords thereon, a manually releasable brake biased to hold said reel against wind up rotation, and a cord collecting comb mounted adjacent said reel with cord receiving slots therein spaced to guide the cords to the individual spools.

6. Cord control apparatus according to claim 5, wherein said cord collector has a sleeve through which the cords pass into the collector, said comb being disposed between said sleeve and said reel.

* * * * *